US008196226B1

(12) United States Patent
Schuh

(10) Patent No.: US 8,196,226 B1
(45) Date of Patent: Jun. 12, 2012

(54) PROTECTIVE HEAD DEVICE FOR REDUCING MTBI

(76) Inventor: Allen John Schuh, Pleasanton, CA (US)

( * ) Notice: Subject to any disclaimer, the term of this patent is extended or adjusted under 35 U.S.C. 154(b) by 0 days.

(21) Appl. No.: 12/986,554

(22) Filed: Jan. 7, 2011

(51) Int. Cl.
*A42B 3/00* (2006.01)

(52) U.S. Cl. ..... 2/412; 2/410; 2/411; 2/413; 2/414; 2/425

(58) Field of Classification Search ..... 2/410, 411, 2/412, 413, 414, 5, 6.1, 6.6, 425
See application file for complete search history.

(56) References Cited

U.S. PATENT DOCUMENTS

| | | | | |
|---|---|---|---|---|
| 4,534,068 | A * | 8/1985 | Mitchell et al. | 2/414 |
| 4,710,984 | A * | 12/1987 | Asper et al. | 2/412 |
| 5,794,271 | A * | 8/1998 | Hastings | 2/412 |
| 7,406,721 | B2 | 8/2008 | Husbands et al. | |
| 7,592,911 | B1 | 9/2009 | Hudgens et al. | |
| 7,797,763 | B2 | 9/2010 | Grau | |
| 7,930,771 | B2 * | 4/2011 | Depreitere et al. | 2/411 |
| 2008/0250549 | A1 * | 10/2008 | Summers et al. | 2/425 |

OTHER PUBLICATIONS

Tepe, V., and Fendley, M., "Screening and Diagnosis of Military mTBI: Review and Analysis", by SURVIVAC, Wright Paterson AFB, Ohio, Jun. 26, 2009, Contract SPO-700-D-1380, TAT 06-67 DO 0187, www.dvbic.org/images/pdfs/Tech-Report-06-67-mTBI-2009.aspx.

* cited by examiner

*Primary Examiner* — Shelley Self
*Assistant Examiner* — Alissa Tompkins
(74) *Attorney, Agent, or Firm* — David Pressman

(57) ABSTRACT

A protective helmet (100) comprises a plurality of layers. A fabric layer (200) conforms to a wearer's head, extending around the head from the top of the head to a point above the ears. A first, conforming hard layer (205) follows and is secured to the fabric layer. A second hard layer (210) conforms to and rests on the previous hard layer, but is not attached to it. A fibrous layer (215) is formed over the second hard layer, and a wet settable friable or frangible material layer, e.g., plaster, (220) is applied over the fibrous layer. The friable or frangible material infiltrates the fiber layer and seals it to the second hard layer. While the friable or frangible material is still wet, a mold (222) or tool (not shown) forms a plurality of lines, e.g., hexagonal trenches (225), in the friable material that extend downward toward the fibrous layer. The mold can optionally be left in place or removed after the plaster hardens. Next, a surface layer (230) of resin is applied over the outside of the layers. The helmet is then trimmed and ready for use and can be worn alone or under another helmet. The friable or frangible layer can break on impact, absorbing energy that would otherwise injure the wearer. The hard layers prevent penetration of objects through the helmet. In an alternative embodiment, accelerometers (105, 110) independently record acceleration of the wearer's skull and the helmet.

20 Claims, 1 Drawing Sheet

PROTECTIVE HEAD DEVICE FOR REDUCING MTBI

BACKGROUND

Prior Art

The following is a list of some prior art that presently appears to be relevant to the field hereof:

| Pat. or Pub. No. | Kind Code | Issue or Pub. Date | Patentee or Applicant |
|---|---|---|---|
| 7,406,721 | B2 | Aug. 5, 2008 | Husbands et al. |
| 7,592,911 | B1 | Sep. 22, 2009 | Hudgens et al. |
| 7,797,763 | B2 | Sep. 21, 2010 | Grau |

Non-Patent Literature

Tepe, V., and Fendley, M., "Screening and Diagnosis of Military mTBI: Review and Analysis", by SURVIVAC, Wright Paterson AFB, Ohio, 26 Jun. 2009, Contract SPO-700-D-1380, TAT 06-67 DO 0187, www.dvbic.org/images/pdfs/Tech-Report-06-67-mTBI-2009.aspx.

The usual stated purpose of modern head protective devices is to prevent penetrating head injuries and to mitigate closed-wound brain injuries. These injuries include mild traumatic brain injury (MTBI), often referred to as a concussion. Some protective devices are listed above and are discussed below:

Husbands et al. show an attachment for a safety helmet that provides protection against sun exposure.

Hudgens et al. show a construction hard hat that has electronic circuitry. The circuitry permits tracking of personnel at a construction site.

Grau shows a bicycle helmet with an attached, adjustable head band.

Modern head protective devices are relatively effective in preventing penetrating head injuries. Many companies manufacture helmets and hard hats that meet safety regulations set by federal and state agencies regarding penetration issues. Military contractors may be required to meet additional requirements. Typically, regulations employ a classification scheme that specifies to the degree of protection from penetration.

If the head is not in motion when it is struck with an object, the impact results in a linear acceleration where, without a helmet, the person is likely to have a point load (force concentrated over a small area), which often results in a skull fracture and a linear injury (line-type fracture). In this situation, any barrier, such as a helmet, would spread the load area, which would reduce the point load, thereby reducing the translation impulse. For this reason helmets generally reduce injury compared to controls (no helmet used). They also prevent skull fracture, subdural hematoma, and sudden death. Although the helmet may prove life saving, the person still might be seriously injured since the traditional helmet cannot protect the brain from moving inside the cranium and enduring injuries upon striking bone.

Specifically, no head protective device has been found to afford good protection against MTBI. The brain is a relatively soft organ comprising a combination of tissues with different densities and mechanical properties that are enclosed within the hard skull. Interspersed with the gray and white matter is the blood supply. Upon an impact to the skull, tissue distortion can be highly variable, depending on several factors, including the magnitude and direction of the impact or force vector. Newton's laws of motion apply. Upon impact the brain and the skull will move at the same speed, but will experience forces at a different rate because of their difference in mass. Anything that reduces the amount of force acting upon them will proportionately reduce the impact of the collision of the brain against the skull, and parts of the brain with other parts, perhaps to the degree that the fluids around the brain can mitigate the shock to a significant level, thus avoiding MTBI in situations where it otherwise would have occurred. When an external blow shakes the brain inside the skull, it temporarily disrupts the brain from working normally by disturbing or even tearing electrical, chemical, and anatomical functional connections, which results in the typical symptoms that lead to a diagnosis that a concussion or MTBI has occurred.

Prior helmet designs have not demonstrated proven adequately useful in the prevention of MTBI, although that has always been a goal.

The point cannot be made too strongly that there is no corrective measure that can undo the damage from a brain injury. Damage to the brain is cumulative and permanent. Thus prevention should be a paramount goal.

Insofar as I am aware, there is no existing framework that details levels of reduction probability of MTBI, although the above-cited technical report by Tepe and Findley suggests criteria to be used in such a classification.

In sum, many prior-art helmets and hard hats can prevent penetration, but all have the drawback of not successfully mitigating the probability of MTBI. This drawback has limited the degree of brain protection available in many jobs. warfare, and recreational activities.

SUMMARY

I have discovered a helmet and its method of construction that increase the protection of the brain from trauma. In one aspect the helmet contains a layered, friable construction that displaces applied forces by breaking apart. This reduction in impulsive force translates directly to a reduction in severity of MTBI and in some cases may prevent it entirely. In another aspect, one or more accelerometers are used to report the magnitude and direction of acceleration experienced by the helmet and the wearer's head during an impacting blow. By virtue of its construction, the helmet is also resistant to puncture.

DRAWING FIGURES

DRAWING FIGURE REFERENCE NUMERALS

| | | | |
|---|---|---|---|
| 100 | Helmet | 105 | Base Accelerometer |
| 110 | Top Accelerometer | 190 | Head |
| 200-220 | Layers | 225 | Impression |
| 230 | Layer | 400 | Microprocessor |
| 405 | Power source | 410 | Transmitter |
| 415 | Indicator | | |

Figure 1:
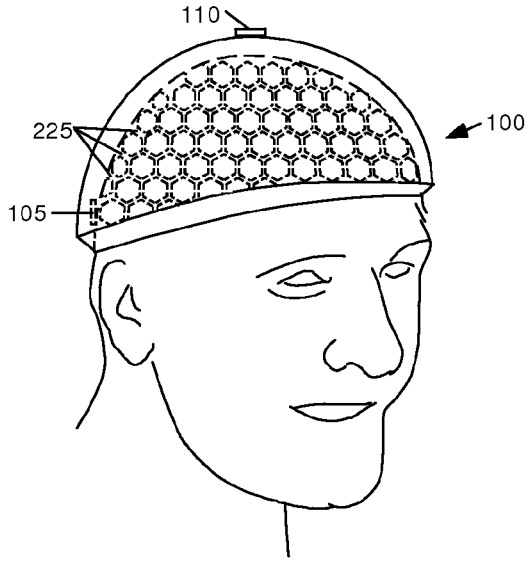
FIG. 1 shows a perspective, view of a helmet according to one aspect of a first embodiment.
Figure 2:
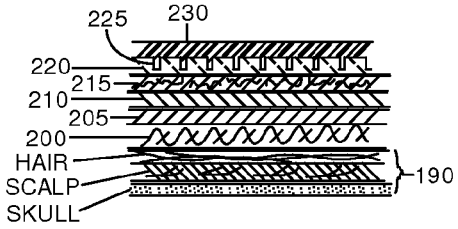
FIGS. 2 and 3 show the composition of layers that form the helmet of FIG. 1.
Figure 3:
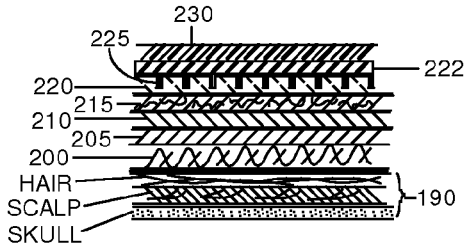

First Embodiment—Description—FIGS. 1 through 3

FIG. 1 shows a first embodiment of a helmet 100 according to one aspect of the present embodiment. Helmet 100 comprises several layers of materials. Each layer is designed to dissipate energy and/or to retard penetration by an external object. The description of the helmet's construction will progress as though it is being custom made to fit a person who may intend to wear it under a construction or demolition hard hat or large straw hat. The helmet can be formed on the wearer's head or on a mannequin of similar size and shape.

FIG. 2 is an un-scaled, sectional side view that illustrates the various layers that make up the helmet. A fabric layer 200 that resembles a stocking cap is first placed over a wearer's or a mannequin's head 190. If the wearer's head is used, the mold should be formed with the wearer's hair at the average length as usually worn, but if a mannequin is used the mannequin should have a quantity hair equivalent to the wearer's average hair length. If, after forming the mold the wearer changes their hair length markedly, e.g., from very long (a very thick layer) to short (a thin layer), or vice versa, or becomes bald, the mold should be re-formed so that it conforms closely to the wearer's actual degree of hirsuteness. Head 190 is shown with a thin layer of hair but the thickness can range from zero for a bald person to very thick for a person with a head of long hair.

The sides of the cap are pulled down to a position level with the top of the wearer's pinnas on the sides, to the wearer's eyebrows on the front, and to just below pinna level at the back of the wearer's neck. Any excess material will be trimmed off when the helmet is finished. Layer 200 is typically made of wool, although other cushioning materials can be used, such as natural or synthetic cloth, plastics, or a combination of these. The thickness of layer 200 is preferably between about 2 and 5 mm, although other thicknesses can be used.

Next, a second layer 205 comprising a thin sheet or plate of rigid protective material, contoured to conform to the wearer's head as covered by fabric layer 200, is placed over layer 200. Layer 205 is preferably made of a strong and durable material such as metal, hard plastic, including fiber-filled plastic, and the like. The surface of layer 205 can be smooth or textured. Layer 205 can be solid or foraminous to permit the use of thread to secure it to fabric layer 200. This layer is scaled in size to fit the wearer's head. Its purpose is to be the last line of defense to penetration and to serve as a base for a movable layer to be placed above it.

The thickness of layer 205 correlates with the class rating against penetration desired in the helmet. At the lowest class, this material is only 1 to 1.5 mm thick, up to a maximum of 3 mm. This material may have small holes (not shown) in it. A small bead or button (not shown) may be inserted through one of the holes near the top center of the helmet to cause the next layer above, layer 210 (discussed infra), to be positioned slightly above layer 205, at least at one point between the layers. A shallow lift of no more than 0.5 mm to partially raise part of layer 210 is sufficient. This gives layer 210 greater mobility in event of disruption. Lower layer 205 need only cover the vital brain areas, i.e., the frontal, temporal (i.e. side), and occipital (i.e. rear) lobes, and a portion of the cerebellum which lies beneath the occipital lobe. Its role is as the last level of defense against an external object that might cause a penetrating wound to a vital area of the brain. However, this is not its primary role, which is to provide a base upon which the layer above it can move.

Next, layer 210 of protective material of similar size to layer 205 is applied to provide a second protective layer. As with layer 205, layer 210 is also made of a smooth or textured, strong, and durable material, such as metal, hard plastic, including fiber-filled plastic, and the like. Layer 210 rests on layer 205 with no direct bonding between the two. Their joint purpose is to serve as a quasi-roller bearing so that anything that contacts the top layer will disturb it and move it over the surface of the lower layer, thus redirecting and distributing the force vector in another direction. The larger the force impacting this layer, the larger the movement of these two layers will be, resulting in and a smaller proportional transfer of energy to the lower levels of protection and ultimately less to the wearer's brain. The size of layer 210 is approximately the size of layer 205 or slightly smaller, but layer 205 should generally not extend more than 10 mm below that of layer 210.

Next, a thin layer 215 of a fibrous material is placed on layer 210. Layer 215 can be coco fiber, hair, various grasses, plastic mat, or any other fibrous material that is matted and stringy, yet sufficiently porous to absorb plaster or a similar adhesive. Layer 215 extends below the outer edges of layers 205 and 210 by about 10 mm. The purpose of layer 215 is to provide a framework for securing the next layer.

Next, a layer 220 of plaster or other suitable fragile. friable, or frangible material for bonding is prepared to a consistency of thick peanut butter, and it is applied over layer 215 to a thickness of about 5-10 mm. Layer 220 fully penetrates layer 215 down to the upper surface of layer 210. Layer 220 extends about 10 mm beyond the lower edges of layers 205 and/or 210, thereby encapsulating layers 205, 210, and 215 and terminating on the outside surface of layer 200. This layer serves as a bonding agent that holds the various layers together.

Before fully dried, the layer 220 is scored with a mold 222 (FIG. 3) or a tool (not shown), which makes deep lines or grooves 225 (FIGS. 1 and 2) and regulates the depth of the layer of plaster, which partially soaks into and over the fibrous material of layer 215. Mold 222 can be made of rubber, plastic, metal, or wood. FIG. 3 shows mold 222 left in place after the plaster in layer 220 dries. This enables layer 220 to absorb more impact before the plaster shatters, if desired, for a higher level of MTBI prevention classification. Presently I prefer a hexagonal grid for the lines or grooves because I believe that this shape spreads force out most efficiently. However any other pattern of scoring lines or grooves may be used (e.g., square, circular, oval, triangular, pentagonal) as long as the lines or grooves form raised areas no more than about 10 mm in size and the lines or grooves are about 2 mm in width. In final appearance, there should be many raised areas with gaps between them to allow the raised areas to break apart when force is applied. The drying of the plaster can be accomplished using solar energy, or by other means such as a blow dryer which supplies relatively dry air. Fast drying plaster sets in five minutes.

Next, a thin layer 230 of epoxy or other waterproof resin such as polyester is applied over the scored plaster surface of layer 220 (FIG. 2) or the surface of mold 222 (FIG. 3), thereby encapsulating all previous layers. Layer 230 typically has a thickness less than 0.5 mm above the top surface of layer 220 or mold 222. Leaving mold 222 in place allows an additional degree of rigidity to withstand normal wear and tear to the peaks of plaster below it. Preferably, the resin in layer 230 is colored bright white, which gives it the greatest visibility in most work settings, although other colors or a clear coat can be used. It can also block a portion of any UV rays that impinge upon the helmet. Two-part resins can form a solid with hardness in direct proportion to the amount of hardener mixed. Suitable hardness of common resins is achieved in about 15 minutes.

Finally, all excess material is trimmed from helmet 100, leaving a smooth edge all around as shown in FIG. 1. At this point the helmet is ready for use. The finished helmet is typically about 15 mm thick, comfortable, and close fitting. It is a protective device that can be worn as is, or under other headgear, which may be soft or firm. It can be inserted into a hard hat by removing or adjusting any existing headband. Such headbands are usually thin plastic that easily slip out of a few slide canals. The attachment of this protective device to the interior of a construction hardhat can be made as a substitute for the typical plastic suspension straps and headband. I.e., the MTBI protective device is used as a liner, held securely in place in the hard hat with a common fastening method, such as a hook-and-loop fastener, or even double-sided tape.

The MTBI reduction helmet, when made with fast drying materials, can be constructed and ready for use in about one hour at a small cost. The thickness of the final product is about equal to the space between the average person's head and most hard hats in use on construction sites today. The helmet can be made thinner or thicker, depending upon the purpose of the wearer and the class of MTBI protection desired.

First Embodiment—Operation—FIGS. 1 and 2

Helmet 100 affords protection to the wearer against both penetration and MTBI injuries. When an object, such as a heavy tool is dropped from above at a construction site and impacts the exterior of the helmet, or when a child falls off a bicycle and hits their head on the pavement, thin resin shell 230 will break, rubber mold 222 will move if attached (FIG. 3), then friable, frangible plaster layer 220 will break, then the rigid surfaces 205 and 210 will move over one another, dissipating more energy. The last hard surface, layer 205, protects the vital parts of the brain from penetration, and stocking cap 200 will be the last line of defense before the hair and skin are impacted. Helmet 100 provides high protection against both penetration and MTBI injuries because all layers will dissipate energy by destructing or moving. By virtue of its construction, the helmet is less massive than other helmet types, such as football helmets. As such, less impulsive force is transferred from one to the other when two such helmets collide, resulting in less possible MTBI for both wearers.

Figure 4:
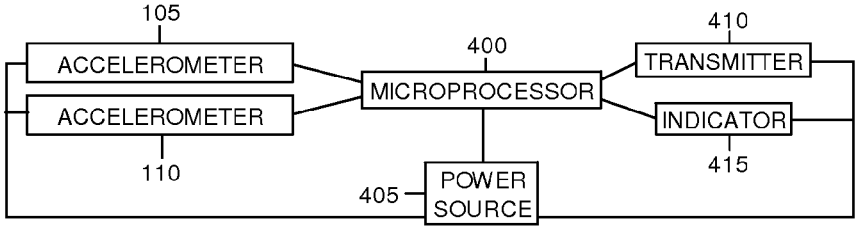
FIG. 4 shows an electronic block diagram of accelerometer circuitry.

Alternative Embodiment—Description—FIGS. 1 and 4

In an alternative embodiment, a pair of electronic accelerometers 105 and 110, such as the model ADXL312 or ADIS 16227, manufactured by Analog Devices, Inc. of Norwood, Mass., USA, are secured to the helmet as it is being formed. Accelerometer 105 is positioned at the base or bottom of the helmet and accelerometer 110 is positioned at the top of the helmet. When in use, these accelerometers measure the acceleration and direction of a force that impacts the helmet. This information is useful to medical personnel in assessing the level of MTBI experienced by a wearer who has received a blow to the head. These accelerometers generate and transmit orthogonal x, y, and z data signals that can be combined into a vector that is representative of acceleration in any direction. The data are sent to a digital device such as a microprocessor where they can be used immediately or stored for later analysis. The signals can be transmitted over wires or through the air or stored in the memory of a microprocessor (not shown) that is also contained within helmet 100.

FIG. 1 shows the locations of two accelerometers affixed to helmet 100. Accelerometer 105 is located inside layer 200, near the back of the wearer's skull and detects acceleration of the wearer's skull in any direction, as determined by the vector result of the x, y, and z signals. Accelerometer 110 is attached to the top of helmet 100 and detects the acceleration of helmet 100 in any direction in a manner similar to that of accelerometer 105. Comparing the accelerations imparted to accelerometers 105 and 110 provides a measure of the protection provided by the helmet, i.e., its effectiveness, during a blow to the wearer's head. Upon an impact to helmet 100, the difference in readings between the two accelerometers provides a measure of the effectiveness of helmet 100 in preventing acceleration of the skull. In addition, the reading of accelerometer 105 reveals the magnitude and direction of acceleration experienced by the wearer's skull. This information can be useful in evaluating the extent of force to the wearer upon an impact.

FIG. 4 shows an electronic block diagram of the accelerometers and related circuitry. A power source 405 energizes accelerometers 105 and 110, a transmitter 410, and an indicator 415. A microprocessor 400 is arranged to receive signals from the accelerometers. Transmitter 410 is arranged to receive and transmit the acceleration data to a receiver (not shown). E.g., if the helmet is used by a soccer or hockey player, the receiver can be on the sidelines. If the helmet is used by a construction worker, the receiver can be in the constriction office. Indicator 415 also receives the acceleration data so that it can preferably be monitored before, during, and after helmet 100 receives an impact. One or both of transmitter 410 and indicator 415 can be used. Microprocessor 400 can be a model 18F2455, manufactured by Microchip, Inc. of Chandler, Ariz., USA. Power source 405 can be a battery. Transmitter 410 can be a radio or optical transmitter arranged to send acceleration data to a remote location. Indicator 415 can be affixed (not shown) to helmet 100 at any convenient location. The data can be stored in the memory of microprocessor 400, at the remote location which can be a computer with memory arranged to store such data, or both.

Alternative Embodiment—Operation—FIGS. 1 and 4

Microprocessor 400 continually monitors the output signals from accelerometers 105 and 110. When helmet 100 receives a blow, microprocessor 400 detects an increase in acceleration and saves acceleration data from a first time just preceding the blow to a second time that occurs after the blow and when the outputs from accelerometers 105 and 110 have returned to normal, i.e., non-impact, readings. As mentioned above, these readings are useful in assessing the amount of impact absorbed by helmet 100 and the degree of possible MTBI received by the wearer.

Conclusion, Ramifications, and Scope

The improved helmet and its method of construction are low in cost and such construction can easily accomplished in a short period of time. The helmet affords a high degree of protection not previously available in headgear, insofar as I am aware. In one aspect, the helmet also reports and stores acceleration from an impacting blow. This information can be useful to medical personnel and also can be used for insurance purposes. The helmet can be worn alone or in combination with other head gear.

While the above description contains many specificities, these should not be considered limiting but merely exemplary. Many variations and ramifications are possible. For example, instead of being about 15 mm thick, the helmet can be made thicker or thinner, depending upon its intended use. The helmet can be made to be resistant to water or other solvents, heat, cold, and the like.

While the present system employs elements which are well known to those skilled in the art of helmet manufacture, it combines these elements in a novel way which produces one or more new results not heretofore discovered. Accordingly the scope of this invention should be determined, not by the embodiments illustrated, but by the appended claims and their legal equivalents.

The invention claimed is:

1. A protective helmet that can be worn by a wearer having a head with a crown or top and sides extending down to said wearer's pinnas, comprising:

a plurality of layers that conform to a wearer's head, said layers extending around said wearer's head from said top or crown of said wearer's head to a point above said wearer's pinnas on the sides of said wearer's head, a first of said layers being made of fabric and designed to rest on said wearer's head, a second of said layers being made of a hard material and resting on said first layer, a third of said layers being made of a hard material and movably resting on said second layer, a fourth of said layers being made of a fibrous material and resting on said third layer, a fifth of said layers being made of a friable or frangible material which extends through at least part of said fibrous material of said fourth layer and to a predetermined height above said fibrous material of said fourth layer, said fifth layer further being scored with a plurality of lines, and a sixth of said layers being made of a resinous material which covers said fifth layer, thereby covering all previous layers, whereby when said wearer wears said helmet and said wearer's head receives a blow, said hard materials in said second and said third layers can reduce penetration of objects through said helmet, and said fibrous and said friable or frangible materials can break, thereby distributing and absorbing the energy of said blow and reducing the possibility that the wearer will experience mild traumatic brain injury.

2. The helmet of claim 1 wherein said scoring of said fifth layer is arranged in a hexagonal pattern.

3. The helmet of claim 1, further including a seventh layer between said fourth and fifth layers, said seventh layer being a mold that contains a relief pattern according to said plurality of lines in said fifth layer, said seventh layer being used to form said plurality of lines in said fifth layer.

4. The helmet of claim 3 wherein said mold is made of materials selected from the group consisting of rubber, plastic, metal, and wood.

5. The helmet of claim 1 wherein said first layer is made of a material selected from the group consisting of wool, natural cloth, synthetic cloth, plastics, and a combination thereof.

6. The helmet of claim 1 wherein said second layer and said third layer are made of a material selected from the group consisting of metals, hard plastics, and fiber-filled plastics.

7. The helmet of claim 1 wherein said fourth layer is made of a material selected from the group consisting of coco fiber, hair, grasses, and plastic mat.

8. The helmet of claim 1 wherein said fifth layer is made of plaster.

9. The helmet of claim 1 wherein said sixth layer is made of a material selected from the group consisting of epoxy and polyester resins.

10. The helmet of claim 1, further including at least one accelerometer and associated electronic circuitry arranged to measure and report the acceleration received by a wearer's head when said helmet is struck with a blow.

11. The helmet of claim 1, further including at least one accelerometer and associated electronic circuitry arranged to measure and report the acceleration received by said helmet when said helmet is struck with a blow.

12. A method for making a protective helmet for a wearer's head or a mannequin head having a top or crown and sides, wherein said helmet extends around said head from a point atop said head and down the sides of said head, comprising:

providing a first layer above said wearer's head or said mannequin's head, said first layer comprising a cloth stocking cap, providing a second layer of hard material above said first layer and resting said second layer on said first layer, providing a third layer of hard material above said second layer and movably resting said third layer on said second layer, providing a fibrous material for a fourth layer above said third layer, providing a friable or frangible material for a fifth layer above said fourth layer, said friable or frangible material of said fifth layer being applied to said fourth layer while said friable or frangible material is in a spreadable condition so that said friable or frangible material infiltrates said fourth layer and extends above said fourth layer by a predetermined amount, forming a plurality of lines or grooves in said friable or frangible material of said fifth layer, and providing a resin material for a sixth layer above said fifth layer, said sixth layer being a resinous coating, thereby encapsulating all previous layers, and trimming all excess material from said helmet, whereby when said helmet is worn on said wearer's head and said helmet is struck with a blow, said helmet helps protect said wearer from mild traumatic brain injury.

13. The method of claim 12 wherein said lines or grooves are formed in said friable or frangible material of said fifth layer using a mold.

14. The method of claim 13 wherein said mold is left in place on said fifth layer after said lines or grooves are formed, so that said mold becomes an additional layer interposed between said fifth and said sixth layers of said helmet.

15. A protective helmet for reducing mild traumatic brain injury when worn on a wearer's head, comprising:

a succession of layers made to conform to said wearer's head and comprising materials selected from the group consisting of soft materials, hard materials, fibrous materials, friable or frangible materials, and resinous coating materials, comprising:

a first layer of soft material arranged to conform to and rest against said wearer's head, a second layer of hard material resting against and over said first layer of said soft material, a third layer of hard material movably resting against and over said second layer of said hard material, a fourth layer of fibrous material formed and resting on said third layer, a fifth layer of friable or frangible material extending through at least part of said fourth layer of fibrous material to said third layer of said hard material and forming a bond between said friable material and said third layer of said hard material, said friable or frangible material further including a plurality of lines or grooves, and a sixth layer of resinous material that encapsulates all previous layers, whereby when said helmet is worn by said wearer and said helmet is impacted, said second and said third layers of said hard material prevent puncture of said helmet, said second and said third layers of said hard material can slide over one-another, thereby dissipating energy of said blow, and said fifth friable or frangible material can break and further dissipate said energy of said blow, thereby reducing or eliminating said mild traumatic brain injury.

16. The helmet of claim 15, further including at least one accelerometer and associated electronic circuitry positioned and arranged to measure and report the acceleration received by the wearer's head when said helmet is impacted.

17. The helmet of claim 15, further including at least one accelerometer and associated electronic circuitry positioned and arranged to measure and report the acceleration received by said helmet when said helmet is impacted.

18. The helmet of claim 15 wherein said soft material of said first layer is made of a material selected from the group consisting of wool, natural cloth, synthetic cloth, plastics, and a combination thereof, and said lines or grooves in said fifth layer are formed in a hexagonal pattern.

19. The helmet of claim 15 wherein said hard materials of said second and third layers are made from at least one material selected from the group consisting of metals, hard plastics, and fiber-filled plastics, and said lines or grooves are formed in a hexagonal pattern.

20. The helmet of claim 15 wherein said fibrous material of said fourth layer is made from a material selected from the group consisting of coco fiber, hair, grasses, and plastic mat, and said lines or grooves are formed in a hexagonal pattern.

* * * * *